US005425821A

United States Patent [19]

Kurup et al.

[11] Patent Number: 5,425,821

[45] Date of Patent: Jun. 20, 1995

[54] IRON ALUMINUM BASED ENGINE INTAKE VALVES AND ITS MANUFACTURING METHOD

[75] Inventors: Mohan Kurup, Richmond Hts.; Roger R. Wills, Solon; Mark S. Scherer, Mentor, all of Ohio

[73] Assignee: TRW Inc., Lyndhurst, Ohio

[21] Appl. No.: 242,733

[22] Filed: May 13, 1994

Related U.S. Application Data

[62] Division of Ser. No. 990,424, Dec. 15, 1992, Pat. No. 5,328,527.

[51] Int. Cl.[6] ..... C22C 38/06; C21C 7/00

[52] U.S. Cl. ..... 148/318; 148/902; 148/226; 148/230; 148/518; 148/320; 29/888.452; 420/77; 420/81

[58] Field of Search ..... 148/318, 902, 518, 211, 148/226, 230, 320; 29/890.123, 890.127, 890.128, 890.129, 890.13, 890.126, 888.4, 888.45, 888.451, 888.452, 888.46; 420/77, 81

[56] References Cited

U.S. PATENT DOCUMENTS 2,172,023 9/1939 Gat .
3,582,323 6/1971 Sawyer et al. .
4,961,903 10/1990 McKamey et al. .
5,084,109 1/1992 Sikka .

*Primary Examiner*—Deborah Yee
*Attorney, Agent, or Firm*—Tarolli, Sundheim & Covell

[57] ABSTRACT

The present invention resides in a method for making an internal combustion engine intake valve. An iron aluminum alloy, in the form of a coil or bar stock, is provided. The alloy comprises 76.05 to 90.15 weight percent iron, 9 to 13.3 weight percent aluminum, 0.05 to 0.35 weight percent carbon, and 0.5 to 3 weight percent of a refractory metal, and/or 0.3 to 1.5 weight percent of titanium in combination with, or in place of, the refractory metal. The coil or bar stock is extruded to a poppet valve preform configuration at a heading temperature in the range of 800° to 2,000° F. and a true strain of about 0.5 to 2.2. The preform configuration is then headed to a pre-machined configuration while maintaining the head of such preform at an effective heading temperature up to 2,200° F. said heading being carried out at a true strain of about 1.4 to 2.3. The headed preform is then machined, to its machined configuration, without intermediate heat treatment, and then is coated by either nitriding or chrome plating. If desired, a hardenable steel tip can be welded to the valve stem, and then heat hardened.

13 Claims, 2 Drawing Sheets

IRON ALUMINUM BASED ENGINE INTAKE VALVES AND ITS MANUFACTURING METHOD

This is a divisional of copending application Ser. No. 07/990,424, filed on Dec. 15, 1992, now U.S. Pat. No. 5,328,527

TECHNICAL FIELD

The present invention relates to the manufacture of intake valves for internal combustion engines, and the use of an iron aluminum alloy in such manufacture.

BACKGROUND OF THE INVENTION

Current trends in internal combustion engine development are towards the use of multi-valve engines capable of operating at higher speeds with higher fuel economy, better engine efficiency, and lower emission levels. The speed-limiting assemblies in an engine are the valve train and the piston assembly. Valve train instability limits engine speed since component breakage and excessive wear will occur in the valve train if it is operated in an unstable mode. For a particular valve train design, the weight of components in the valve train is a major cause of this instability. The heaviest moving part in the valve train is the valve itself.

It is thus desirable to reduce the weight of the valve. In addition to increasing valve train stability, this reduces the amount of engine power used to drive the valve train, and improves fuel consumption. Another advantage of reducing valve weight is that it enables the use of more aggressive cam profiles to open valves earlier and close them later than in conventional practice. This improves volumetric efficiency, and hence increases engine power.

Still further, gains in fuel economy can be realized by proportionately reducing valve spring loads which are designed to control valve motion. The dynamic stresses resulting from valve seat loading are proportional to valve weight, and consequently lower contact stresses from light weight valves will reduce the wear of the seat insert material.

The current approach to lighter weight valves is to reduce valve mass by using narrower stems, or a hollow stem, and to remove material from the valve head. It is estimated that the use of an iron aluminum alloy will realize a weight savings equivalent to that obtained by the use of a hollow valve stem, made from a standard SAE 1541 steel intake valve material.

DESCRIPTION OF THE PRIOR ART

The iron aluminum system forms a series of solid solutions from 0 to 52 atomic percent aluminum. At room temperature, alloys with less than 18.5 atomic percent (about 10 weight percent) aluminum are BCC solids solutions with a disordered structure. However, alloys with 18.5 to 35 atomic percent (about 10 to 18 weight percent) aluminum form a $DO_3$ ordered structure, and alloys greater than about 35 atomic percent (greater than about 18 weight percent) aluminum form the cubic B2 ordered structure.

Two widely used intake valve materials are a 1541 martensitic carbon-manganese steel that can be cold extruded and warm headed, and a SIL-1 (Silcrome) material having a high silicon and high chromium content. The compositions of these materials are:

| Ingredient | Weight Percent 1541 | SIL-1 |
|---|---|---|
| Carbon | 0.35–0.45 | 0.4–0.5 |
| Manganese | 1.25–1.75 | 0.2–0.6 |
| Silicon | 0.15–0.35 | 3–3.5 |
| Chromium | — | 8–9 |
| Iron | Balance | Balance |

The alloy 1541 currently has the highest volume share of the automotive intake valve market. The alloy SIL-1 has some properties, including oxidation resistance, which are better than those of the 1541 alloy. The SIL-1 alloy is widely used for heavy duty intake valve applications, for instance truck engines.

U.S. Pat. No. 3,582,323 to Sawyer et al. discloses an iron aluminum composition useful for exhaust valves in internal combustion engines. The composition comprises 30 to 50 atomic percent aluminum, about 17.1–32.6 weight percent. A preferred composition is 38–42 atomic percent aluminum. This composition contains primarily the intermetallic compound FeAl which is relatively brittle. The composition cannot, therefore, be considered practical for use in the manufacture of intake valves for internal combustion engines.

U.S. Pat. No. 4,961,903 to McKamey et al. discloses iron aluminum alloys of the $DO_3$ type. The alloys have 26–30 atomic percent aluminum. Most of the alloys contain boron. The alloys are designed for use in advanced energy corrosion systems. No reference is made in the patent to the use of the alloys in the manufacture of intake valves for internal combustion engines.

U.S. Pat. No. 5,084,109 to Sikka also discloses iron aluminum alloys of the $DO_3$ type. The alloys have about 25–31 atomic percent aluminum. The patent discloses a thermomechanical treatment, including quenching the B2 ordered phase at room temperature, to improve the ductility of the iron aluminide alloys. The implication in the patent is that the alloys are useful in structural applications. No reference is made in the patent to use of the alloys in the manufacture of intake valves for internal combustion engines.

U.S. Pat. No. 2,172,023 to Gat discloses iron aluminum alloys which are relatively low in aluminum content, about 8% by weight (15 atomic percent). Thus, the alloys have a disordered structure. The patent highlights the detrimental effects of carbide precipitation along grain boundaries in iron aluminum alloys, and discloses the use of carbide formers, such as molybdenum, tantalum, columbium, and titanium, to produce fine carbides uniformly distributed throughout the iron aluminum alloy mass.

SUMMARY OF THE INVENTION

The present invention resides in a method for making internal combustion engine intake valves. An iron aluminum alloy, in the form of a coil or bar stock, is provided. The alloy comprises 76.05 to 90.15 weight percent iron, 9 to 13.3 weight percent aluminum, 0.05 to 0.35 weight percent carbon, and 0.5 to 3 weight percent of a refractory metal, and/or 0.3 to 1.5 weight percent of titanium in combination with, or in place of, the refractory metal. The coil or bar stock is extruded to a poppet valve preform configuration at a temperature in the range of 800° to 2,000° F. and a true strain of about 0.5 to 2.2. The preform configuration is then headed to a pre-machined configuration while maintaining the head of such preform at a temperature which usually is higher than the extrusion temperature, preferably in the range of 1800° F. to 2,200° F., said heading being carried out at a true strain of about 1.4 to 2.3.

The pre-machined configuration is then processed without heat treatment, by grinding to the required outside dimensions, and is then stem coated, by either nitriding or chrome plating.

A hardenable stem or tip may be attached to the valve stem, to form the final valve.

Preferred refractory materials are selected from the group consisting of molybdenum, vanadium, niobium, tungsten and tantalum.

In one embodiment of the present invention, the iron aluminum alloy comprises, on a weight basis, 10% to 11.5% aluminum, 0.07% to 0.25% carbon, 0.3% to 1.5% titanium, and 0.5% to 0.8% zirconium, the balance being iron.

In another embodiment of the present invention, the iron aluminum alloy comprises, on a weight basis, 10.5% to 11.8% aluminum, 0.07% to 0.32% carbon, and 0.8% to 1.6% vanadium, the balance being iron.

The present invention also resides in an intake valve made by the above methods.

The present invention also resides in a two piece intake valve, in which a first portion of the valve is made by the above methods, and a second portion is a hardenable steel tip or stem welded to the first portion by resistance or friction welding.

BRIEF DESCRIPTION OF THE DRAWINGS

The foregoing and other features of the present invention will become apparent to those skilled in the art upon consideration of the following description of the present invention with reference to the accompanying drawings, in which.

DESCRIPTION OF PREFERRED EMBODIMENTS

Figure 1:
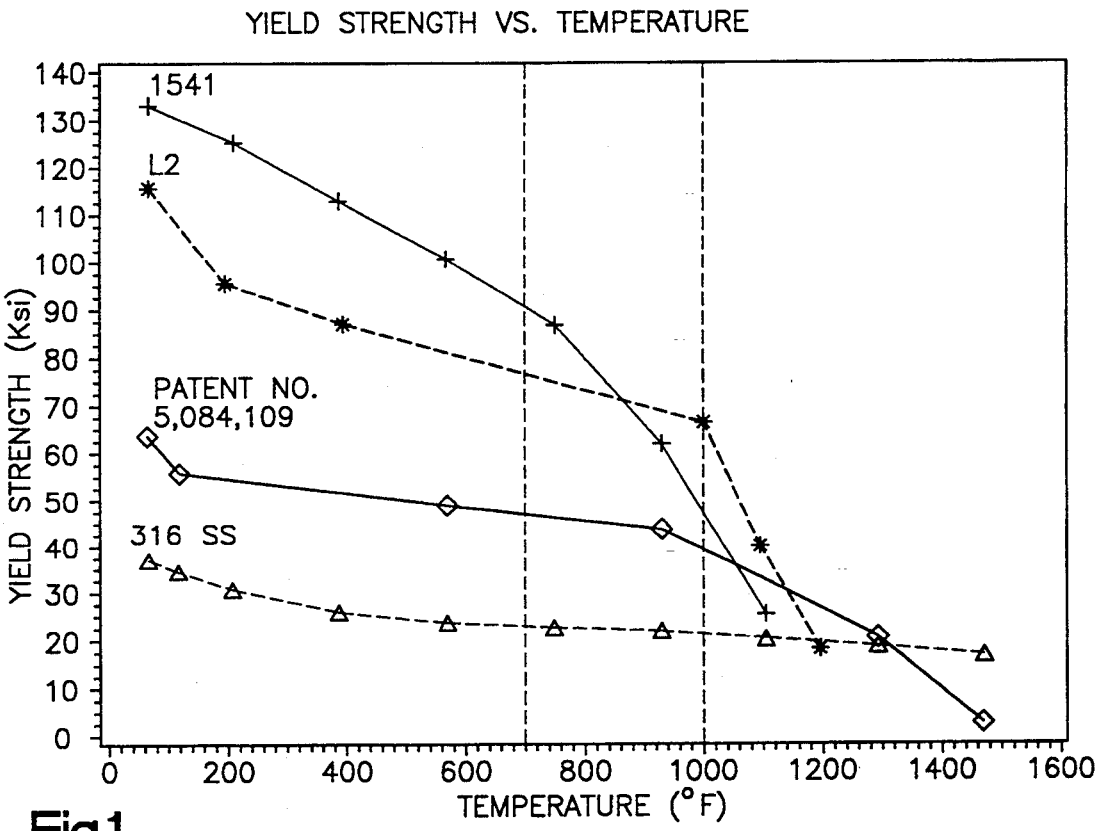
FIG. 1 is a graph comparing the yield strength of parts made in accordance with the present invention with the yield strength of parts made in accordance with the prior art.

In the present application, all percentages are on a weight basis unless otherwise specified. Temperatures are in degrees Fahrenheit. The following data is also disclosed.

Hardness: This value is obtained using the Rockwell (Rc) method of hardness testing.

True Stress: The true stress is equal to the load, in thousands of pounds (k), divided by the instantaneous area in square inches ($in^2$) at the time of the stress measurement.

True Strain The true strain is the log of the initial area divided by the instantaneous area.

The method of the present invention comprises a first step of providing a bar or coil stock in the as-rolled and machined condition. The bar or coil stock may, if desired, be annealed. The specific diameter of the bar or coil stock is selected following known procedures, and is dependent upon such considerations as the composition of the bar or coil stock, the final diameters of the valve stem and valve head desired, and the process used for the extrusion of the stem; that is, whether warm or hot extrusion is employed.

The bar or coil stock of the present invention is an iron aluminum alloy. The alloy comprises broadly 76.05 to 90.15 weight percent iron, 9 to 13.3 weight percent aluminum, 0.05 to 0.35 weight percent carbon, and 0.5 to 3 weight percent of a refractory metal, and/or 0.3 to 1.5 weight percent of titanium, in combination with, or in place of, the refractory metal.

More specifically, the composition of the present invention comprises:

| Ingredient | Weight Percent |
|---|---|
| Aluminum | 9 to 13.3 |
| Carbon | 0.05 to 0.35 |
| Refractory metal | 0.5 to 3* |
| Titanium | 0.3 to 1.5* |
| Zirconium | 0 to 1 |
| Manganese | 0 to 1 |
| Silicon | 0 to 0.8 |
| Chromium | 0 to 3 |
| the balance being iron | |

*In the alternative or in combination.

Preferred refractory metals are selected from the group consisting of molybdenum, vanadium, niobium, tungsten and tantalum.

The aluminum, in the iron aluminum alloys of the present invention, provides weight reduction. In addition, it provides excellent oxidation resistance. At least 9 weight percent aluminum is required, in the iron aluminum alloys, to provide sufficient weight reduction and sufficient oxidation resistance at valve operating temperatures. A preferred lower limit is 10% aluminum. At more than 13.3 weight percent aluminum, long range order (ordered structure) results, in turn giving lower yield strength. In addition, higher weight percents aluminum tend to embrittle the alloy, because of the tendency of the aluminum to increase the ductile to brittle transition temperature. This in turn increases the susceptibility of iron aluminum alloy parts made to environmentally and thermally induced cracking.

The range of about 9 to 13.3 weight percent aluminum, in the alloys of the present invention, provides an optimum ease of formability into finished valves, while at the same time avoiding long range order in the as-formed and air-cooled valves.

The carbon, in the iron aluminum alloys of the present invention, may be carbon in the steel used as a base material in the preparation of the alloys, or may be carbon added. The carbon is present in alloys of the present invention only in combination with potent carbide formers such as titanium or a refractory metal. These carbides form precipitates which are uniformly dispersed or distributed through the iron aluminum mass. The precipitates improve high temperature strength by retarding recrystallization and by controlling unusual grain growth. A maximum useful level for carbon is 0.35 weight percent. At levels greater than 0.35 weight percent, the rolling capability of the alloy drops dramatically, making it difficult to form the alloy into a valve. At least about 0.05 weight percent carbon is desirable for achieving high temperature strength.

The amount of carbide former, such as titanium, and/or a refractory metal, is that necessary to react with the carbon which is present. The double carbide of iron and aluminum has a face-centered cubic structure which embrittles the iron aluminum alloy, by precipitation along grain boundaries. Carbon also increases the ductile to brittle transition temperature, making the iron aluminum alloys brittle.

In the case of a refractory metal, at least 0.5 weight percent is necessary. Suitable refractory metals are vanadium, molybdenum, niobium, tungsten, and tantalum.

The upper limit for the refractory metal is about 3 weight percent. For instance, the presence of free vanadium, in the amount of about 1.5 weight percent, without 0.3 weight percent carbon, reduces the room temperature ductility of the iron aluminum alloy by about 30%. Also, it was found that about 1.5 weight percent vanadium, without 0.3 weight percent carbon, reduced the creep resistance of the iron aluminum alloys by an amount comparable to the reduction in ductility.

Similarly, it was found that molybdenum, in the alloys of the present invention, in the absence of carbon, for instance in an amount of more than about two weight percent, caused embrittlement of the iron aluminum alloys.

Accordingly, an upper practical limit for vanadium is about 1.6 weight percent, in the presence of sufficient carbon to form carbides of vanadium. Similarly, a practical upper limit for molybdenum, in the alloys of the present invention, is about 1.8 weight percent, in the presence of a sufficient amount of carbon to form carbides of molybdenum.

The carbides of the refractory elements also provide hardness and wear resistance to the tip and stem portions of the engine valves.

In the case of titanium, at least about 0.3 weight percent is necessary to react with the carbon. An upper limit for the titanium is about 1.5 weight percent.

The alloys of the present invention can also contain up to about one weight percent zirconium in combination with carbon. The zirconium does not stay in solid solution. It is excellent for forming uniform precipitates throughout the matrix.

The Compositions of the present invention can also comprise additional elements, such as up to one percent by weight manganese and up to 0.8% by weight silicon. These are considered to be trace elements, and are a by-product from the use of commercial steels as the raw materials for the iron aluminum alloys of the present invention.

Examples of compositions of the iron aluminum alloys of the present invention are shown in the following Table 1.

TABLE 1

COMPOSITION OF THE IRON ALUMINUM ALLOYS IN WEIGHT %

| | Alloys | | | | | |
|---|---|---|---|---|---|---|
| Element | L2 | L2C | E7A | E8A | E9A | E4A |
| Carbon | 0.29 | 0.29 | 0.09 | 0.09 | 0.19 | 0.17 |
| Nitrogen | 0.005 | <0.01 | 0.01 | 0.01 | 0.01 | 0.01 |
| Manganese | | 0.51 | | | | 0.46 |
| Sulfur | | | | | | |
| Oxygen | 0.001 | .0042 | | | | |
| Aluminum | 10.5 | 11.68 | 11.25 | 11.32 | 11.43 | 10.53 |
| Vanadium | 1.3 | 1.53 | 1.54 | | | |
| Titanium | | | | 0.58 | .059 | .056 |

TABLE 1-continued

COMPOSITION OF THE IRON ALUMINUM ALLOYS IN WEIGHT %

| | Alloys | | | | | |
|---|---|---|---|---|---|---|
| Element | L2 | L2C | E7A | E8A | E9A | E4A |
| Zirconium | | | | 0.59 | 0.57 | 0.84 |
| Molybdenum | | | | 0.70 | 0.73 | |
| Iron | Bal | Bal | Bal | Bal | Bal | Bal |

The manufacturing sequence for making the intake poppet valves of the present invention follows broadly conventional practice. A bar or coil stock of predetermined diameter is provided. A blank of desired length is cut from the bar or coil stock. The blank is then reduced in diameter, for instance by extrusion, for its length, except at its head end. The head end of the blank, which has not been extruded, is then coined to a larger cross-section.

In accordance with the present invention, the extrusion of the blank is carried out at a temperature in the range of 800° to 2,000° F. and true strain of about 0.5 to 2.2. The heading is carried out at a suitable heading temperature which usually is a higher temperature than the extrusion temperature, preferably in the range of 1800° F. to 2,200° F. The heading is carried out at a strain of 1.4 to 2.3.

At the higher temperatures, for instance more than 1,800° F., the shaping steps, including extrusion and heading, can be characterized as hot forging. Normally, this is performed in a mechanical crank and screw press, utilizing hot-work tooling, at an average production rate of about 14 to 20 pieces per minute.

Some of the alloys disclosed in Table 1, for instance the alloy designated E4A, can be warm extruded at temperatures of 750° to 950° F. This provides the capability of making valves from these alloys, of the present invention, on a header forming process. This process has the advantage of higher production rates, for instance 60 to 100 pieces per minute. The process also provides intake valve pieces having a straighter, more net shape, than pieces manufactured by hot forging.

In this process, the blanks are warm extruded at temperatures of 750° to 950° and then are coined at a higher temperature, preferably at more than 1,800° F.

To keep up with the high production rate in the extrusion step, the gathered end is preferably externally heated to coining temperature, by using an induction heat source.

An aspect of the present invention is that the alloys of Table 1 do not require heat treatment following extrusion and coining. The next step in the manufacturing process for conventional intake valves, such as those made using the 1541 alloy or SIL-1 alloy, is heat treatment. This is required to develop the proper hardness and microstructure in the valves. The absence of a need for heat treatment, with the alloys of the present invention, results in a time and cost savings.

Preferably, the valves of the iron aluminum alloys of the present invention are straightened at temperatures of about 400° F. or more. This is readily accomplished by placing the straightener in line with the extrusion and coining process, and the residual heat in the valve, from the previous forming operations, is utilized for the straightening step. This eliminates the need for a separate reheating step.

Depending on the type of engine that the valves of the present invention go into, the valves may have a tip or stem welded to them. This has the advantage of providing extra tip wear resistance. Lack of tip wear resistance can give rise to excessive tappet lash in internal combustion engines, resulting in over-heating of the valve head and eventual valve failure.

For instance, the valve head and some of the stem portion may be made from the light weight iron aluminum alloys of the present invention, set forth in Table 1, and the remaining stem portion from any hardenable standard steel like SAE 4140. An SAE 4140 steel has the following composition, on a weight basis:

| Ingredient | Weight Percent |
|---|---|
| Carbon | 0.38–0.43 |
| Manganese | 0.75–1.0 |
| Phosphorous | 0.035 max |
| Sulfur | 0.040 max |
| Silicon | 0.15–0.30 |
| Chromium | 0.8–1.1 |
| Molybdenum | 0.15–0.25 |
| Iron | Balance |

The advantage of an SAE 4140 tip is that it can be easily hardened to an Rc hardness of more than about 50. The two portions can be joined by different techniques. One preferred technique is friction welding. The alloy L2C of the present invention, in Table 1, has been successfully friction welded to on SAE 4140 steel stem.

It is also possible to resistance or projection weld an SAE 4140 steel tip to the valve stem of an iron aluminum alloy of the present invention. Steel tips made of SAE 4140 steel, having a thickness in the range of about 0.06 to 0.1 inch, have also been successfully projection welded to a 0.3 inch diameter valve stem of the iron aluminum alloy L2C shown in Table 1.

For a production valve, the acceptable push-off strength requirement for such a weld is 1,800 pounds. The welds made on the iron aluminum alloys of the present invention had much higher push-off strengths, of 2,800 to 3,300 pounds.

The valves of the present invention are machined to specifications, without intermediate heat treatment, and then are preferably finished by chrome plating or nitriding. The purpose of chrome plating or nitriding is to develop good scuffing resistance. The aluminum, in the alloys of the present invention, facilitates, in a salt bath nitriding process carried out at 1,060° F., for 60 minutes, the formation of a deep hard compound layer having a thickness of about 815 microinches. The valve stems made from alloys of the present invention, can also be chrome plated. A chrome plate, on the valve stem of the iron aluminum alloy L2, of Table 1, has a good surface finish and a depth of 35 microinches. The adherence of the coating to the valve stem is excellent. The specified maximum finish for a valve, Ra (root mean square value), is 18 microinches. Valves made from the alloy L2C, of Table 1, and chrome plated, had an average Ra value of 13 microinches.

The following Examples illustrate the present invention.

EXAMPLE 1

Good yield strength is an important property for an intake valve alloy. High yield strengths, at operation temperatures, are necessary for the intake valves to resist what is called "cupping". This is the most pronounced deformation which leads to valve failure.

The yield strength is determined by machining a test specimen to a diameter of 0.125 inch. The specimen is then heated to a test temperature in a furnace, and is then pulled, at a rate of 0.05 inch per minute, in a Baldwin Testing Machine. The stress required to pull the specimen, at this rate and temperature, is plotted in Ksi, as a function of the strain. From this graph, the yield strength is measured. The yield strength is identified as the stress corresponding to the 0.2% strain. This yield strength can be determined, for each specimen, at different temperatures.

In this Example, slugs having the composition L2, of Table 1, and a diameter of 0.74 inch, were rolled to a diameter of 0.5 inch, and then were machined to the test diameter of 0.125 inch. The slugs were tested at temperatures in the range from room temperature to about 1500° F. The yields strength values which were obtained are plotted in FIG. 1 as a function of the test temperature.

Samples of intake valves having the composition SAE 1541 were also obtained. These intake valves are marketed by the assignee of the present application under the trade designation "VMS-31". SAE 1541, as mentioned, is a standard low carbon, martensitic steel, intake valve material that can be cold-extruded and warm-headed. This alloy currently has the highest volume share of the automotive intake valve market.

Test specimens of the SAE 1541 valves were also prepared, by machining to the desired test diameter, and were then tested for yield strength, at different temperatures, using the above procedure. The results are also shown in FIG. 1.

FIG. 1 also contains yield strength data for a 316 stainless steel, and for a composition from U.S. Pat. No. 5,084,109. The yield strength for a 316 stainless steel, at different temperatures, can be obtained from a handbook. The composition selected from U.S. Pat. No. 5,084,109, for the purpose of comparison, is identified in the patent as "$Fe_3Al$+2% Cr alloy". This alloy contains 25–31% aluminum and 2% chromium. It has a B2 type ordered structure. Tensile data, including yield strength at different temperatures, is given in Table III of the patent. The 316 stainless steel data, and the yield strength data from Table III of the U.S. Pat. No. 5,084,109, is also shown in FIG. 1.

The operating temperature regime for most automotive intake valves is within the range of about 700° to about 1,000° F. This is the area in FIG. 1 bracketed by the dashed vertical lines.

As can be seen from FIG. 1, in this operating temperature range, the yield strength for the iron aluminum alloy L2 of the present invention was comparable to that provided by the alloy 1541. In addition, valve pieces made with the alloy L2 were 14% lighter than those made with the alloy 1541.

In the same operating range, the alloy L2 of the present invention provided almost a 200% higher yield strength than that of the alloy of U.S. Pat. No. 5,084,109, and almost a 400% higher yield strength than those of the 316 stainless steel.

EXAMPLE 2

The performance of intake valve alloys is related to their creep rupture, namely time dependent deformation at constant stress and elevated temperature. This is an important property, and is measured using the creep rupture test. The lack of creep strength at operating temperature can lead to premature valve failure.

In the creep rupture test, a specimen, having a diameter of 0.125 inch, a nominal length of 1.12 inches, and a gauge length of 0.5 inch, is heated in air to a test temperature. A predetermined load (stress) is then applied, and the percent elongation is measured at that load, as a function of time.

Figure 2:
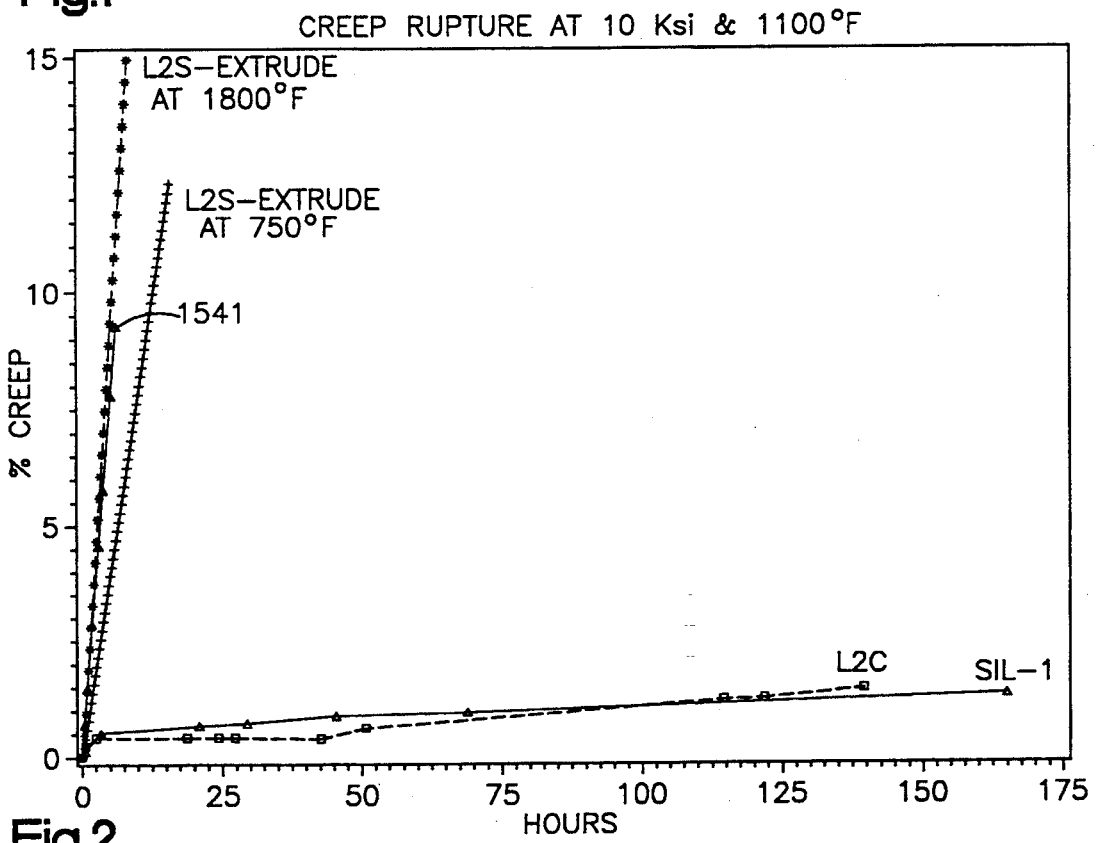
FIG. 2 is a graph comparing the creep resistance at 1,100° F. of parts made in accordance with the present invention against the creep resistance at 1,100° F. of parts made in accordance with the prior art.

FIG. 2 summarizes the data for creep at 1,100° F. and a stress of 10 Ksi, for one of the iron aluminum alloys of the present invention, L2C, in Table 1. Valves of the L2C alloy were made from slugs having a diameter of 0.74 inch and a length of 1.316 inches. The slugs were heated in a gas-fired furnace to a temperature of 1650° F. for fifteen minutes. The slugs were then extruded to a stem diameter of 0.290 inch. The coining of the valve heads was done after reheating the valves to 1830° F., to a head diameter of 1.312 inches. Following this operation, the valve stems were straightened at 500° F. The valves were subsequently finish ground to a stem diameter of 0.273 inch and a head diameter of 1.272 inches, and were chrome plated. Specimens for the creep rupture test were obtained from these valves.

FIG. 2 also summarizes the data for creep at 1,100° F., and a stress of 10 Ksi, for specimens from valves made from the alloy SIL-1. SIL-1, as mentioned above, is the most widely used alloy for making heavy duty intake valves. SIL-1 valves are marketed by the assignee of the present application under the trade designation "VMS-42".

FIG. 2 also provides data for specimens from valves made from the 1541 alloy, and specimens from valves made from an iron aluminum alloy identified as L2S.

This iron aluminum alloy L2S has the following composition:

| Ingredient | Weight Percent |
|---|---|
| Carbon | 0.08 |
| Nitrogen | 0.01 |
| Manganese | 0.26 |
| Sulfur | 0.007 |
| Aluminum | 11.5 |
| Iron | Balance |

The L2S alloy contained neither a refractory metal nor titanium. The L2S alloy was extruded to a valve shape at both 750° F. and 1,800° F., and then was coined and chrome plated, using the same procedure as given above with respect to the alloy L2C. The 750° F. warm extrusion was performed using the header process at speeds of 60 parts per minute, while the 1,800° F. extrusion was performed in a Maxipress at a speed of 10–14 parts per minute. A Maxipress is a 1000 ton machine manufactured by the AJAX Manufacturing Company. The model number, on the particular machine used, is 3816.

The creep tests, for the L2S alloy specimens extruded at both 750° F. and 1,800° F., were performed at 1100° F. and 10 ksi.

As can be seen from FIG. 2, valves made from the iron aluminum alloy L2C of the present invention performed as well, in creep resistance, as valves made from the alloy SIL-1, significantly better than valves made from the alloy 1541, and also significantly better than valves made from the iron aluminum alloy L2S, which were extruded at either 1800° or 750° F. In this latter respect, this Example illustrates the importance, to the present invention, of the presence of a refractory metal in the iron aluminum alloy, up to about five weight percent, and/or titanium, up to about three weight percent.

A creep resistance parameter for intake valves is less than 2% elongation following heating in a furnace for 100 hours at 1100° F. under 10000 psi tension. As shown in FIG. 2, the valves of the present invention having the composition L2C were well within this parameter.

EXAMPLE 3

Because of the high number of valve openings and closings during the life of an internal combustion engine, the fatigue life of the valve alloy is an important property used in poppet valve design.

The fatigue life is measured using the R. R. Moore fatigue test. This is a high temperature test. In this test procedure, a twelve inch long fatigue specimen is used. A gauge section is heated to the test temperature, in this instance, 1100° F., by using a furnace and is maintained at this temperature during the entire test cycle. The sample is rotated at 5000 RPM. A test load is applied to the sample through the bearing housing. The test is run at this temperature and stress until the sample fails. A counter records the number of revolutions to failure, which is then plotted as the number of cycles, against stress, giving the standard fatigue curve (S-N curve).

The fatigue test was performed using the iron aluminum alloy of the present invention designated L2, in Table 1. The results of the R. R. Moore fatigue test, at 1,100° F., for this alloy, are plotted in FIG. 3. Comparative data is also presented in FIG. 3 on an alloy disclosed in U.S. Pat. No. 4,961,903, designated FA-129. The data plotted in FIG. 3 for this alloy was obtained from the '903 patent. The alloy FA-129 had the following composition:

| Ingredient | Weight Percent |
|---|---|
| Aluminum | 15.8 |
| Chromium | 5.4 |
| Niobium | 1 |
| Carbon | 0.05 |
| Iron | Balance |

Figure 3:
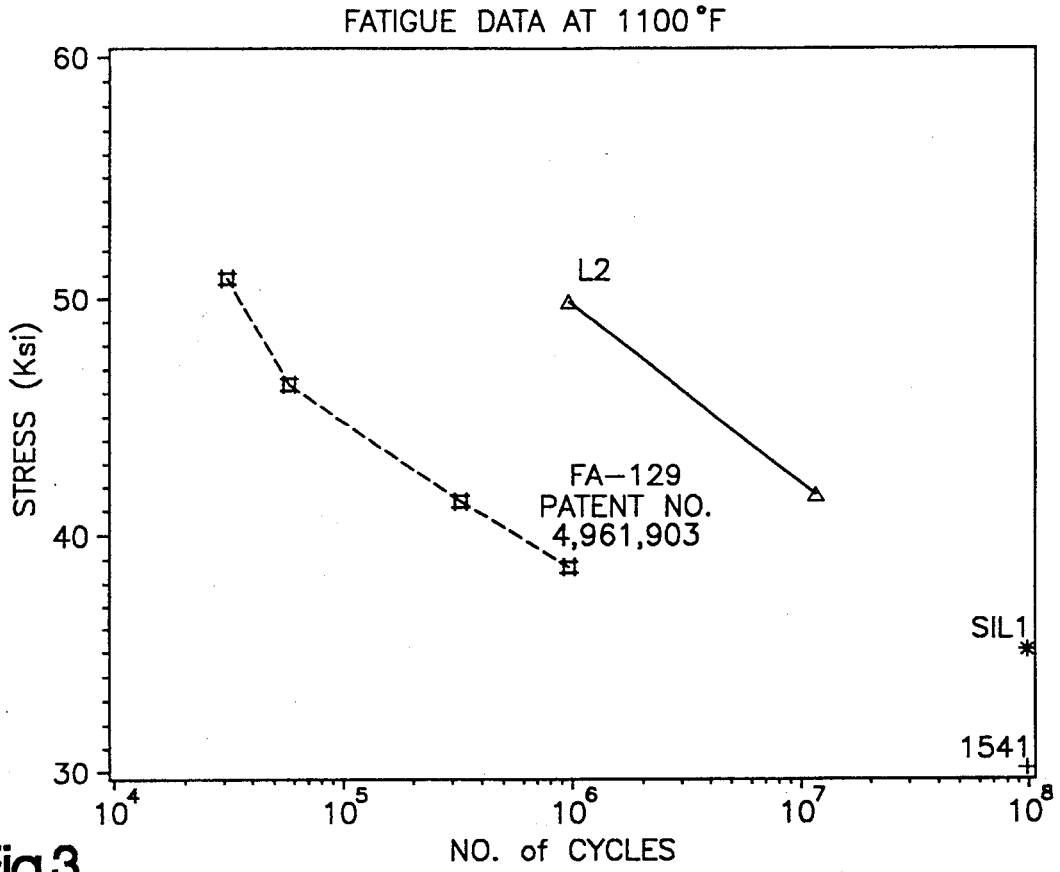
FIG. 3 is a graph comparing the fatigue resistance at 1,100° F. of parts made in accordance with the present invention against the fatigue resistance at 1,100° F. of parts made in accordance with the prior art.

Data is also provided in FIG. 3, for the SIL-1 and 1541 alloys. As can be seen in this Figure, the stress result to $10^8$ cycles, achievable by the iron aluminum alloy L2, was equivalent, by extrapolation, to that achievable by the heavy duty intake valve alloy SIL-1, and was better than that achievable by the alloy 1541. The alloy L2 had considerably better fatigue strength than the alloy FA-129 of U.S. Pat. No. 4,961,903.

EXAMPLE 4

Yet another important property for valve alloys is the oxidation resistance of the alloys at operating temperatures. The alloy SIL-1 is used for heavy duty intake valve applications, primarily because of its superior oxidation resistance, compared to the 1541 alloy. The property, oxidation resistance, is measured using the following procedure. A specimen with a surface area of 1.18 inches squared and 0.3 inch diameter is used for this test. The specimen is heated in a furnace to a temperature of 1100° F., in air for 100 hours. At the end of the oxidation period the specimen is air cooled to room temperature and the surface is wire brushed to remove all of the oxides. The oxidation is then expressed as the mass loss per unit area.

Figure 4:
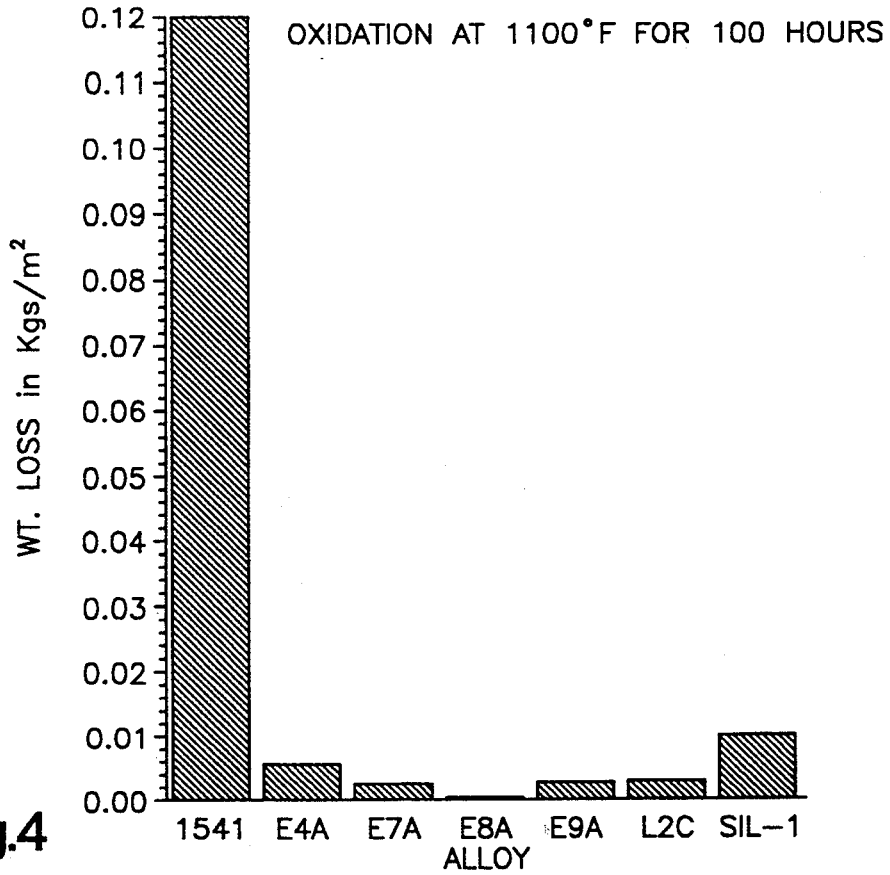
FIG. 4 is a bar graph comparing the oxidation resistance of the alloys of the present invention against the oxidation resistance of commercial valve alloys.

FIG. 4 summarizes the data from the oxidation resistance test at 1,100° F., in air after 100 hours, for a large number of alloy materials. As can be seen in this Figure, the iron aluminum alloys of the present invention have superior oxidation resistance, even compared to the alloy SIL-1, and almost thirty times better oxidation resistance than the most widely used intake valve alloy, 1541.

The above Examples 1–4 establish that the alloys of the present invention have properties which are equal to or better than current intake valve alloys. At the same time, valves made from the alloys of the present invention are considerably lighter than current intake valves.

EXAMPLE 5

Two intake valves having the composition L2C were made following the procedure given above in Example 2. The valves were machined and straightened as described. The valves were then tested in a 1.9 liter internal combustion engine using a standard 400 hour General Motors Corporation, durability test. This is a standard test used by automobile manufacturers to validate the use of production intake valves in their engines. The test was run in a Saturn DOHC, 1.9 liter engine for a duration of 400 hours. During the test the following 30 minute cycle was repeated. The engine cycles between 2000 and 6200 rpm at full load for 27 minutes. This is followed by a 2 minute idle period and a brief speed burst of 6750 rpm. Then this 30 minute cycle is repeated. The engine tested iron aluminum valves of the present invention compared very favorably with intake valves made from the alloy 1541. The iron aluminum valves also met all other engine property requirements.

EXAMPLE 6

This Example illustrates the procedure for friction welding together valve stem pieces of different compositions. In this procedure, the two valve stems are joined together by heat generated from friction. A 0.329 inch diameter SAE 4140 stem was joined to an L2C valve stem having a diameter of 0.325 inch. The L2C stem was held stationary, while the 4140 steel stem was rotated at high RPM. The two pieces were then touched together to generate heat and, by applying a slight pressure when the interface was hot, a successful weld joint was created.

EXAMPLE 7

This Example illustrates the procedure for resistance welding together valve stem pieces of different composition. This procedure was used to weld an SAE 4140 tip to an L2C valve stem.

The tip material was held in an upper electrode, while a lower electrode clamped the valve stem. The machine set-up conditions for this weld were a 10 cycle squeeze; 85 percent total power applied for 10 cycles, followed by no current for 10 cycles. During this sequence, the upper electrode was brought down and the 4140 tip was made to contact the top of the valve stem. The resistance to current flow generated heat at the interface and stem material, and formed the weld joint. During the contact cycle the stress applied was about 1300 psi.

The 4140 tip was then hardened selectively by an induction coil, followed by oil quenching.

The shear force required to break the tip off the valve stem (push-off strength) was then measured. The following data was obtained:

The L2C stem diameter =0.27"

4140 tip thickness in the valve axial direction =0.09"

For a 0.30" diameter valve stem the specification on push-off strength=1800 lbs.

Actual push-off strength for the L2C tipped valve=2800 to 3300 lbs.

The 4140 tip is readily heat hardenable to hardness values greater than Rc=50.

From the above description of the invention, those skilled in the art will perceive improvements, changes and modifications. Such improvements, changes and modifications within the skill of the art are intended to be covered by the appended claims.

Having described the invention, the following is claimed:

1. An internal combustion engine valve having an iron aluminide composition comprising 9–13.3 weight percent aluminum, and a disordered structure for improved high temperature properties.

2. An intake valve for an internal combustion engine, comprising an iron aluminum alloy, made by the steps comprising:

(a) providing a coil or bar stock of an iron aluminide alloy comprising 9–13.3 weight percent aluminum, and a disordered structure;

(b) extruding said coil or bar stock to a poppet valve preform configuration at a temperature in the range of 800° to 2,000° F. and a true strain of about 0.5 to 2.2;

(c) heading said preform to a pre-machined configuration while maintaining the head of said preform at an effective heading temperature up to 2,200° F.; and (d) grinding said headed preform, without heat treatment, to a machined configuration.

3. The valve of claim 2 including the step of stem coating said valve by either nitriding or chrome plating.

4. The valve of claim 2 wherein said heading is carried out at a true strain of about 1.4 to 2.3.

5. The valve of claim 2 having a hardenable steel tip welded to the valve stem, said tip being heat hardened.

6. The valve of claim 2 wherein said heading is carried out at a temperature in the range of 1800° F. to 2200° F.

7. A method for making an intake valve for an internal combustion engine comprising the steps of:

(a) providing a coil or bar stock of an iron aluminide alloy comprising 9–13.3 weight percent aluminum, and a disordered structure;

(b) extruding said coil or bar stock to a poppet valve preform configuration at a temperature in the range of 800° to 2,000° F. and a true strain of about 0.5 to 2.2;

(c) heading said preform to a pre-machined configuration while maintaining the head of said preform at an effective heading temperature up to 2,200° F.; and (d) grinding said headed preform, without heat treatment, to a machined configuration.

8. The method of claim 7 wherein said extrusion is carried out at a speed of 60 to 100 strokes per minute.

9. The method of claim 7 further comprising the steps of welding a hardenable steel tip to the valve stem, and heat hardening said tip.

10. The method of claim 7 further including the step of nitriding or chrome plating said valve stem.

11. The method of claim 7 wherein said heading is carried out at a temperature in the range of 1800° F. to 2200° F.

12. A light weight poppet valve made by the method of claim 7.

13. A valve made using the alloy of claim 1 having a creep resistance equal to or less than 2% elongation following heating in a furnace for 100 hours at 1100° F. under 10,000 psi tension.

* * * * *